US009410703B2

(12) United States Patent
Bunel et al.

(10) Patent No.: US 9,410,703 B2
(45) Date of Patent: Aug. 9, 2016

(54) DEVICE FOR INJECTING A MIXTURE OF AIR AND FUEL INTO A TURBINE ENGINE COMBUSTION CHAMBER

(71) Applicant: SNECMA, Paris (FR)

(72) Inventors: Jacques Marcel Arthur Bunel, Thiais (FR); Gilles Ulryck, Ballancourt sur Essonne (FR)

(73) Assignee: SNECMA, Paris (FR)

( * ) Notice: Subject to any disclaimer, the term of this patent is extended or adjusted under 35 U.S.C. 154(b) by 644 days.

(21) Appl. No.: 13/836,510

(22) Filed: Mar. 15, 2013

(65) Prior Publication Data

US 2013/0283803 A1 Oct. 31, 2013

(30) Foreign Application Priority Data

Mar. 29, 2012 (FR) ..... 12 52856

(51) Int. Cl.
*F23R 3/14* (2006.01)
*F23R 3/28* (2006.01)
*F23R 3/60* (2006.01)

(52) U.S. Cl.
CPC . *F23R 3/286* (2013.01); *F23R 3/14* (2013.01); *F23R 3/283* (2013.01); *F23R 3/60* (2013.01); *F23D 2211/00* (2013.01); *F23R 2900/00017* (2013.01)

(58) Field of Classification Search
CPC ..... F23R 3/14; F23R 3/283; F23R 3/286; F23R 3/60; F23R 2900/00017; F23D 2211/00
USPC ..... 60/737, 772, 746, 754, 776
See application file for complete search history.

(56) References Cited

U.S. PATENT DOCUMENTS

| | | | | |
|---|---|---|---|---|
| 4,525,996 | A | 7/1985 | Wright et al. | |
| 6,164,074 | A | 12/2000 | Madden et al. | |
| 2002/0178734 | A1 | 12/2002 | Stastny | |
| 2005/0039458 | A1 | 2/2005 | Leen et al. | |
| 2006/0207258 | A1 | 9/2006 | Tanner et al. | |
| 2007/0033950 | A1 | 2/2007 | Bernier et al. | |
| 2008/0245074 | A1 * | 10/2008 | Oda et al. | 60/737 |
| 2011/0000216 | A1 | 1/2011 | Imamura et al. | |
| 2011/0131998 | A1 * | 6/2011 | Nadkarni et al. | 60/737 |
| 2012/0198653 | A1 | 8/2012 | Tanner et al. | |
| 2012/0304649 | A1 * | 12/2012 | Matsuyama et al. | 60/737 |

FOREIGN PATENT DOCUMENTS

| | | |
|---|---|---|
| EP | 1 508 743 A2 | 2/2005 |
| EP | 1 731 837 A2 | 12/2006 |

OTHER PUBLICATIONS

French Preliminary Search Report issued Nov. 21, 2012, in Patent Application No. FR 1252856, filed Mar. 29, 2012 (With English Translation of Category of Cited Documents).

* cited by examiner

*Primary Examiner* — Jesse Bogue
*Assistant Examiner* — Dapinder Singh
(74) *Attorney, Agent, or Firm* — Oblon, McClelland, Maier & Neustadt, L.L.P.

(57) ABSTRACT

A device for injecting a mixture of air and fuel into a turbine engine combustion chamber, the device including a mechanism for centering a fuel injector, which mechanism is movable radially in a support mechanism fastened to a wall of the chamber, the support mechanism carrying a retaining mechanism for axially retaining the centering mechanism on a side opposite from the chamber wall, the retaining mechanism being fastened in releasable manner to the support mechanism.

9 Claims, 4 Drawing Sheets

DEVICE FOR INJECTING A MIXTURE OF AIR AND FUEL INTO A TURBINE ENGINE COMBUSTION CHAMBER

The present invention relates to a device for injecting a mixture of air and fuel into a combustion chamber of a turbine engine such as an airplane turbojet or turboprop.

An injection device of this type has centering means for centering a fuel injector, which means are movable radially in support means that are fastened to a wall of the chamber in order to absorb differential thermal expansion between the various parts in operation.

An injection device may comprise various elements, including: a centering ring for centering the head of a fuel injector, at least one radial or axial swirler, a Venturi, a bowl pierced by orifices for passing air, and a sheath for mounting and supporting the device, the sheath being fastened in an orifice in the end wall of the chamber by brazing.

There are two different technologies for mounting this type of injection device. In the first, the centering ring has an outer radial rim slidably mounted in an annular groove of support means that may then comprise a swirler, a Venturi, a bowl, and a sheath of the above-mentioned type. The annular groove for radial movement of the ring is defined in this technology by an upstream radial wall of the swirler and by an upstream washer that is fitted to the swirler and fastened thereto.

In a second technology, the ring, the swirler, the Venturi, and the bowl form a single-piece unit that has an outer radial rim slidably mounted in an annular groove of the sheath that forms the above-mentioned support means. The annular groove for radial movement of the centering means in this technology is defined by an upstream radial wall of the sheath and by an upstream washer fitted to the sheath and fastened thereto.

In both of the above-mentioned technologies, the axial retaining means for axially retaining the centering means relative to the support means in an upstream direction, i.e. away from the chamber, are formed by the above-mentioned washer that is fitted to the support means and that is fastened thereto by weld beads.

The washer is thus fastened to the support means in non-releasable manner. Should it be necessary to replace all or some of the centering means of an injection device during a maintenance operation, it is necessary to destroy the washer, which constitutes an operation that is difficult since there must be no damage to the sheath, which is brazed to the chamber wall. Furthermore, breaks have already been observed in such weld beads, and that is not acceptable.

A particular object of the present invention is to provide a simple, effective, and inexpensive solution to the problems of the prior technologies.

To this end, the invention provides a device for injecting a mixture of air and fuel into a turbine engine combustion chamber, the device comprising centering means for centering a fuel injector, which means are movable radially in support means for fastening to a wall of the chamber, the support means carrying retaining means for axially retaining the centering means on a side opposite from the chamber wall, the retaining means are fastened in releasable manner to the support means, the device being characterized in that the retaining means comprise at least one peg carried by the support means, a latch engaged on the peg and holding the centering means against the support means, and a pin having one end portion engaged and prevented from moving in a housing of the peg and having an opposite end portion bearing against the latch to prevent it from moving relative to the peg.

The centering means of the injection device can thus easily be released from the support means, e.g. during a maintenance operation. There is no longer any risk of breaking weld beads fastening the retaining means that retain the centering means since such weld beads are eliminated in the invention, which has the advantage of being suitable for use in both of the above-described technologies.

According to another characteristic of the invention, the support means comprise at least one radially outer wall or tab for guiding or bearing against the centering means, and the retaining means are releasably fastened to said wall or tab.

The support means may comprise two diametrically opposite tabs extending radially outwards.

The centering means may also include two radially outer tabs that are diametrically opposite and that are held against the tabs of the support means by the retaining means. The retaining means may pass through orifices or notches in the tabs of the centering means with circumferential and radial clearance so as to allow relative movements in a radial direction and in a circumferential direction between the centering means and the support means.

Advantageously, the tabs of the centering means are held against the tabs of the support means by two mutually independent retaining means. Even in the unlikely event of one of the retaining means breaking or failing, the other retaining means can thus hold the centering means in position. Furthermore, the retaining means are situated at a distance from the fuel injector and therefore do not impede mounting it and guiding it in operation.

According to the invention, the retaining means comprise at least one peg carried by the support means, a latch engaged on the peg and holding the centering means against the support means, and a pin having an end portion engaged and held stationary in a housing of the peg, with the opposite end portion thereof bearing against the latch in order to prevent it from moving relative to the peg.

In order to remove the retaining means, it suffices to deform the pin once more so as to release the latch. The pin is then discarded and needs to be replaced with a new pin.

The latch may include a groove into which the end portion of the pin remote from the peg is folded down by plastic deformation.

The housing in the peg may be L-shaped and may include a transverse passage receiving one end of the pin and a longitudinal slot connecting the transverse passage to one end of the peg.

The axis of elongation of the slot in the peg may be in alignment on the longitudinal axis of the peg. In a variant, the axis of elongation is parallel to and offset from the axis of the peg, thereby serving to create keying means that prevent the latch being wrongly mounted, since the latch can be mounted only in one single position on the peg.

Preferably, the peg is engaged in an orifice of the support means and includes an annular shoulder bearing axially against the support means, the shoulder including keying means co-operating by connecting shapes with complementary means of the support means. The peg is correctly positioned when the keying means of the peg co-operate with the complementary means of the support means.

The invention also provides a turbine engine combustion chamber and a turbine engine such as an airplane turboprop or turbojet, characterized in that they include at least one injection device as described above.

The invention can be better understood and other characteristics, details, and advantages thereof appear more clearly on reading the following description made by way of non-limiting example and with reference to the accompanying drawings, in which.

Figure 1:
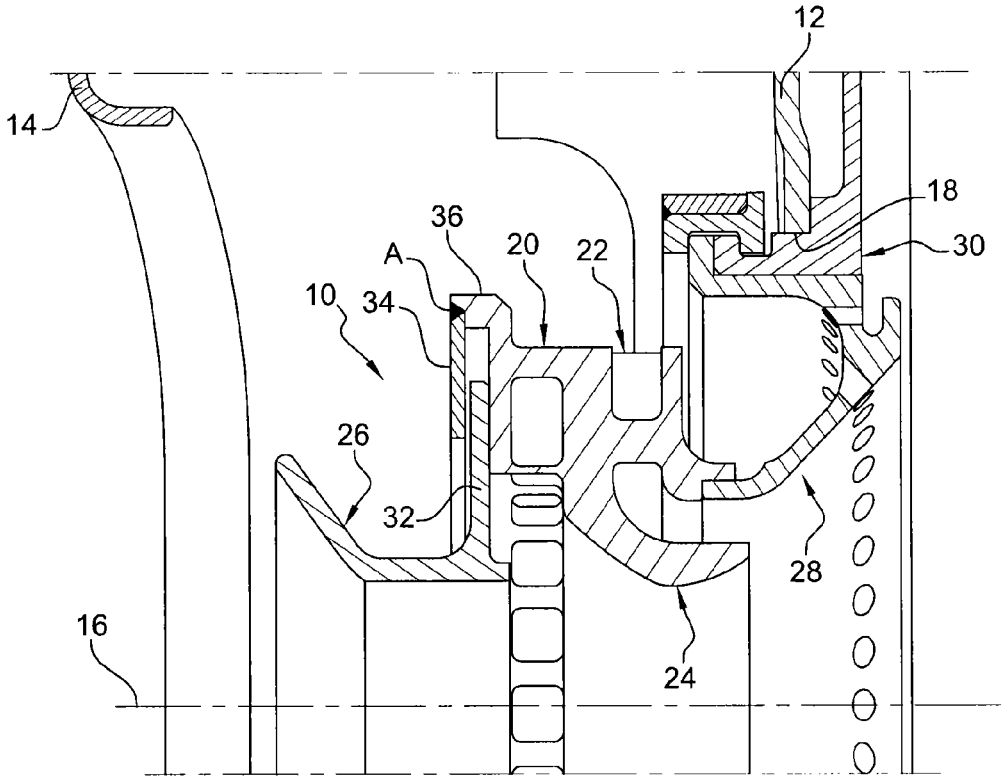
FIG. 1 is a diagrammatic half-view in axial section of a prior art turbine engine device for injecting a mixture of air and fuel.

FIG. 1 shows a device 10 for injecting a mixture of air and fuel into a combustion chamber of a turbine engine such as an airplane turbojet or turboprop, with only an end wall 12 and an upstream annular fairing 14 of the combustion chamber being shown in part.

The air fed to the injection device 10 comes from an upstream diffuser (not shown), and the fuel is brought in by an injector fastened to an outer casing (not shown) of the chamber. Each injector has a fuel injection head of axis that is represented diagrammatically by a chain-dotted line 16, and it is aligned on an axis of an orifice 18 in the chamber end wall 12.

The FIG. 1 injection device 10 has two coaxial swirlers, respectively an upstream swirler 20 and a downstream swirler 22, that are separated from each other by a Venturi 24, and that are connected upstream to means 26 for centering the injector head, and downstream to a mixer bowl 28 that is fastened to a sheath 30 mounted axially in the orifice 18 of the chamber end wall 12, and brazed thereto.

The means for centering the injector head comprise a ring 26 through which the head passes axially and including an annular rim 32 extending radially outwards and slidably mounted in an annular groove. This groove is defined downstream by an upstream radial wall of the upstream swirler 20 and upstream by a washer 34 that is fitted to the upstream end of the swirler 20 and that is fastened by its outer periphery being welded (at A) to an upstream cylindrical rim 36 of the swirler 20.

In the technology shown in FIG. 1, the means for centering the device 10 are formed by the ring 26 and its support means are formed by the sheath 30, the bowl 28, the swirlers 20, 22, the Venturi 24, and the washer 34, the washer 34 forming means for axially retaining the ring 26 in the upstream direction.

Figure 2:
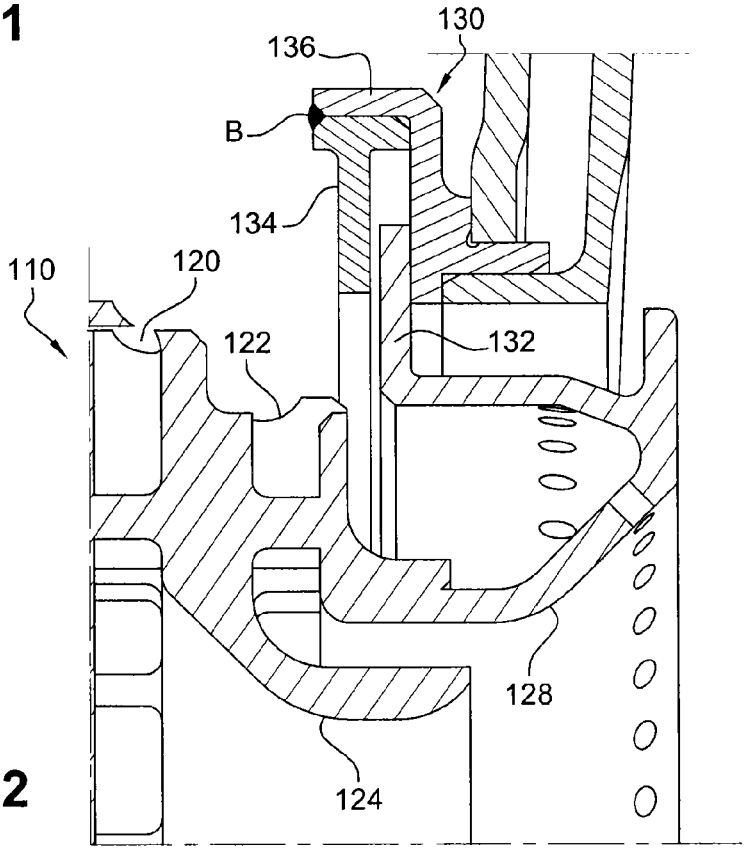
FIG. 2 is a fragmentary diagrammatic half-view in axial section of another prior art turbine engine device for injecting a mixture of air and fuel.

Reference is now made to FIG. 2, which shows another known technology for mounting an injection device 110, and which differs from that described above in that the centering means in this example comprise an upstream ring (not shown), radial swirlers 120, 122, a Venturi 124, and a bowl 128, which are fastened to one another so as to form a one-piece unit. The bowl 128 has an annular rim 132 extending radially outwards and housed in an annular groove of support means that, in this example, comprise a sheath 130 and an upstream washer 134 having its outer periphery fastened by welding (at B) to an upstream cylindrical rim 136 of the sheath. The groove is defined downstream by a radial wall of the sheath 130 and upstream by the washer 134.

As explained above, the two above-described technologies present drawbacks associated with the retaining washers 34 and 134 of the centering means being fastened by weld beads, which weld beads may be weakened and may be in danger of breaking in operation.

The invention enables that problem to be remedied by releasable fastening of the centering means on the support means of an injection device, where the releasable fastening does not require welding.

FIGS. 3 to 15 show an embodiment of the invention.

Figure 3:
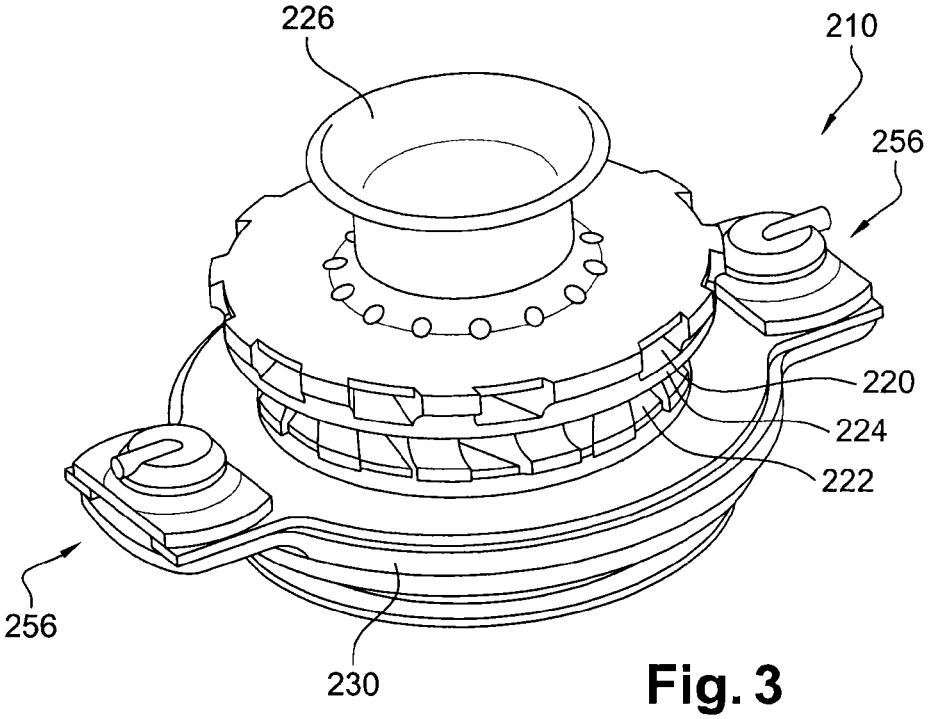
FIG. 3 is a diagrammatic perspective view of a turbine engine device of the invention for injecting a mixture of air and fuel.
Figure 4:
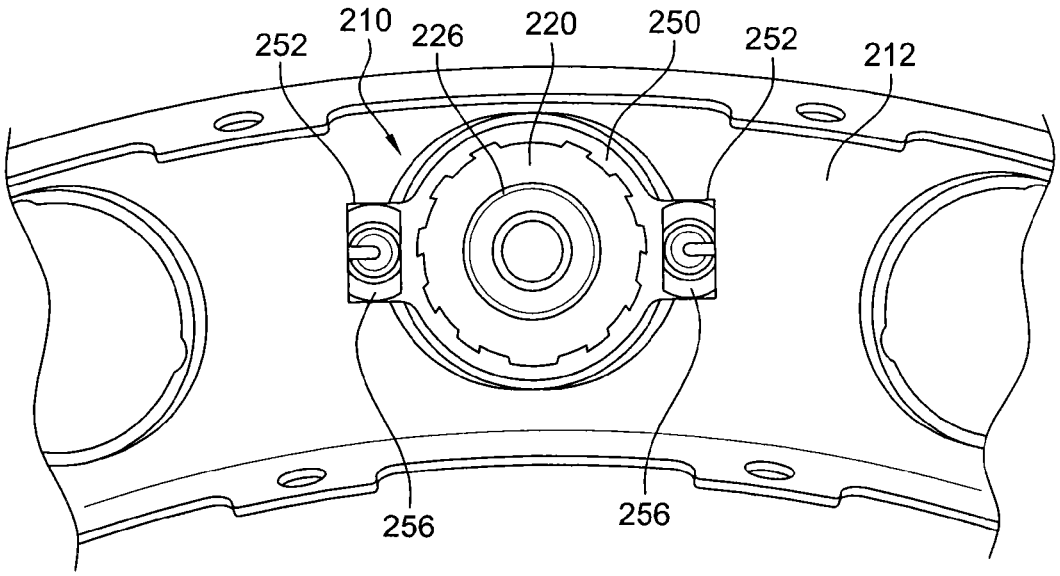
FIG. 4 is a fragmentary diagrammatic view of a combustion chamber end wall carrying a device of the invention, in face view from upstream.

The injection device 210 of the invention is shown in perspective in FIG. 3 and in the mounted position in FIG. 4. As in the prior technologies, the device 210 may comprise a ring 226 having an injection head passing therethrough, two radial swirlers 220 and 222 that are separated from each other by a Venturi 224, a bowl (not shown), and a sheath 230 for fastening the device 210 to a chamber end wall 212.

In the example shown, the centering means of the device comprise a ring 226, the swirlers 220, 222, the Venturi 224, and the bowl, which together form a one-piece unit. The support means comprise the sheath 230, which is shown in the mounted position in FIG. 5, the sheath 230 being engaged in an orifice 218 of the chamber end wall 212 and being brazed thereto. The device 210 is thus similar to the technology shown in FIG. 2. Nevertheless, in a variant, the device 210 could be of the same type as the technology shown in FIG. 1.

In the invention, the centering means are retained and fastened in releasable manner on the support means. In the example shown, the centering means comprise an outer annular rim 250 carrying two radially outer tabs 252 that are diametrically opposite, which tabs are movable radially and circumferentially over corresponding tabs 254 of the sheath 230, and are retained and held on those tabs by releasable retaining means 256.

Figure 5:
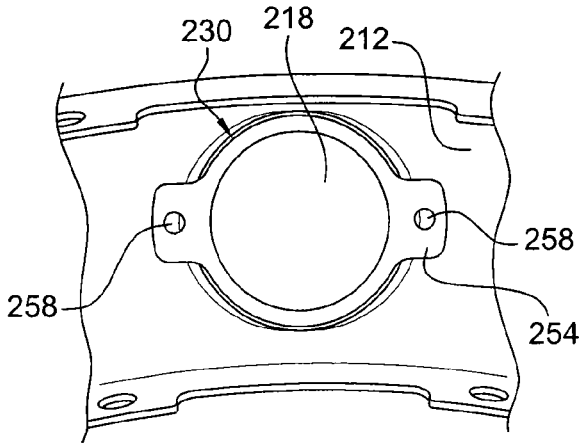
FIG. 5 is a fragmentary diagrammatic view of the FIG. 4 chamber end wall, the wall carrying a sheath of the device of the invention.
Figure 6:
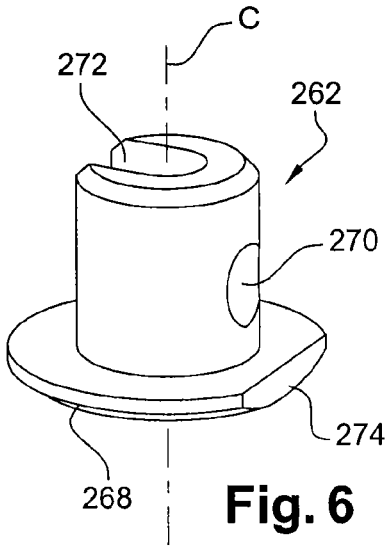
FIG. 6 is a diagrammatic view in perspective of a shouldered peg of retaining means of the device of the invention.

The tabs 254 of the sheath 230 can be seen in FIG. 5. These tabs 254 extend radially outwards and they are diametrically opposite about the axis of the sheath 230, which axis coincides with the axis of the orifice 218 of the wall 212 in which the sheath 230 is mounted. In the mounted position, these tabs 254 extend upstream of the wall 212, i.e. outside the combustion chamber, and they are both on a common circumference centered on the axis of the combustion chamber.

Each tab 254 of the sheath 230 has a through axial orifice 258 for mounting retaining means 256.

Figure 10:
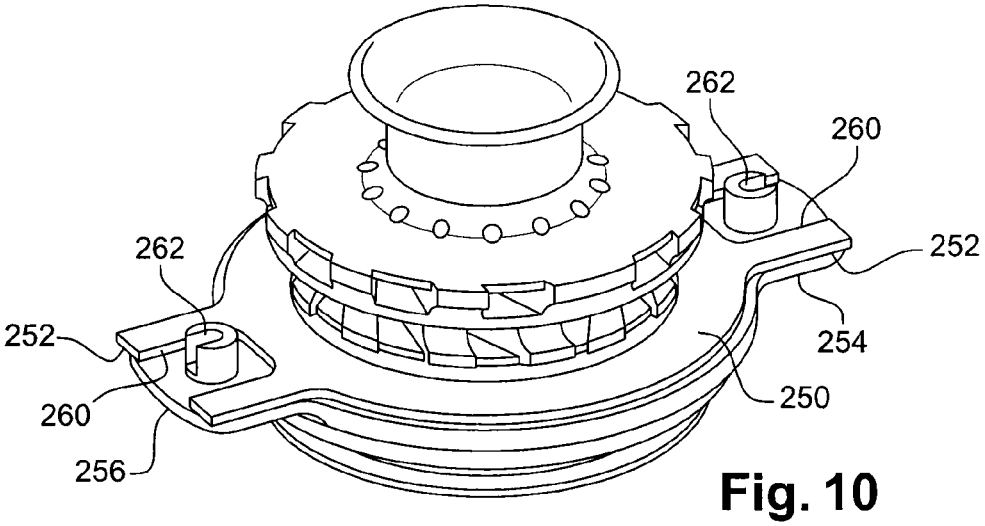
FIG. 10 is a view corresponding to FIG. 3 with the retaining means of the device of the invention partially withdrawn.

The tabs 252 of the centering means can be seen in FIG. 10. These tabs 252 have through axial notches 260 in their radially outer ends, each of these notches 260 subdividing the tab into two portions that are to extend on circumferential end regions of the tabs 254 of the sheath, as can be seen in FIG. 10.

Figure 11:
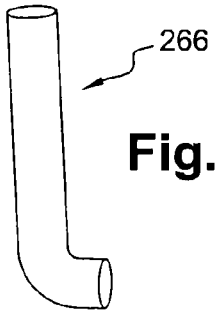
FIG. 11 is a diagrammatic perspective view of a pin of the retaining means of the device of the invention.

Each retaining means 256 comprises a peg 262 (shown in FIG. 6), a latch 264 (shown in FIG. 13), and a pin 266 (shown in FIG. 11).

The peg 262 comprises a cylindrical body carrying an annular shoulder 268 at one end. The body of the peg 262 is hollowed out in part and includes an open through passage 270 substantially in its middle and a longitudinal slot 272 connecting the passage to the end of the peg remote from the shoulder 268. The passage 270 has a section of circular shape and the slot 272 has a section that is substantially U-shaped. The passage 270 and the slot 272 form a substantially L-shaped housing inside the peg 262.

Figure 7:
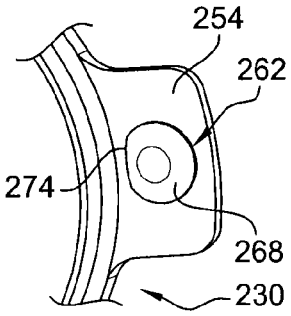
FIGS. 7 and 8 are fragmentary diagrammatic views in perspective of the FIG. 6 peg mounted on the FIG. 5 sheath.
Figure 8:
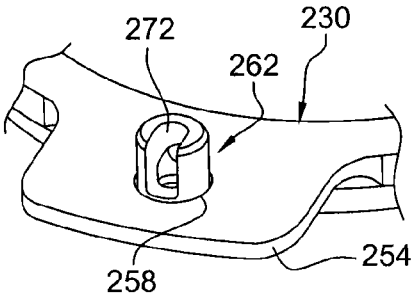
Figure 9:
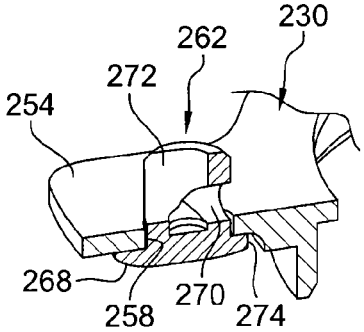
FIG. 9 is a fragmentary diagrammatic view in perspective and in axial section of the FIG. 6 peg mounted on the FIG. 5 device.

The peg 262 is mounted in an orifice 258 of a tab 254 of the sheath 230, as shown in FIGS. 7 to 9. The body of the peg 262 passes through this orifice 258, and the shoulder 268 of the peg comes to bear against a radial face of the tab 254, which is the downstream radial face of the tab in the example shown (FIG. 7).

In the mounted position, the slot 272 in each peg 262 opens radially outwards relative to the axis of the device 210, i.e. away from the radially opposite retaining means. In order to guarantee that the peg is in this angular position in the orifice 252 of the sheath 230, the peg 262 includes keying means that co-operate with complementary means of the sheath 230. In the example shown, the shoulder 268 of the peg includes a flat 274 that is to face an annular rim of the sheath 230 so as to allow the peg to be mounted and to bear against the above-mentioned face of the sheath. In the event of the peg not being correctly angularly positioned in the orifice 252 in the sheath, its shoulder 268 comes into abutment against the above-mentioned rim of the sheath 230 and prevents it from coming to bear against the tab 254.

The peg 262 may be held stationary on the tab 254 by brazing.

The pin 266 is generally L-shaped and has two mutually perpendicular rectilinear portions of different lengths. Each portion has a section that is substantially circular in shape, and that is substantially complementary to the shape of the passage 270 and of the bottom of the slot 272 in the peg. By way of example, the portions of the pin present a diameter of about 1.8 millimeters (mm).

Figure 12:
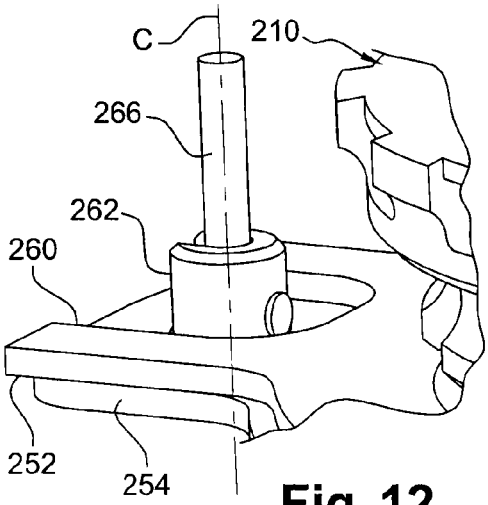
FIG. 12 is a fragmentary diagrammatic view in perspective of the pin and of the peg of the retaining means of the device of the invention, and it shows a step during the mounting of these means.
Figure 13:
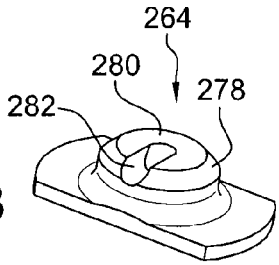
FIG. 13 is a diagrammatic view in perspective of the latch of the retaining means of the device of the invention.

As can be seen in FIG. 12, the shorter portion of the pin 266 is for engaging in the passage 270 of the peg 262, and its longer portion extends in part inside the slot 272 of the peg. The pin 266 is engaged in the housing of the peg by being moved in translation in a plane containing the axis C of the peg, and substantially in the middle of its slot 272 and its passage 270, until it comes to bear against the bottom of the slot 272. In the mounted position, as shown in FIG. 12, the axis of the longer portion of the pin 266 coincides with the axis C of the peg. Once deformed, the peg 266 is generally Z-shaped.

The latch 264 comprises a substantially rectangular plate having a cylindrical boss 278 on one of its faces, and it is made with a through orifice 280 that extends substantially through the middle of the boss 278 and of the plate. The top end of the boss 278 has a transverse groove 282 connecting the end of the orifice 280 that is situated remote from the plate to the periphery of the boss.

The orifice 280 has a top portion and a bottom portion, the top portion having a diameter that is smaller than the diameter of the bottom portion, and these two portions are connected together by a cylindrical shoulder 284. The bottom portion of the orifice 280 has a section of circular shape complementary to the shape of the body of the peg 262, and the top portion of the orifice has a section that is circular in shape and complementary to the shape of the pin 266. The groove 282 in the latch has a section that is C-shaped or U-shaped and that is substantially complementary to the section of a portion of the pin 266.

Figure 14:
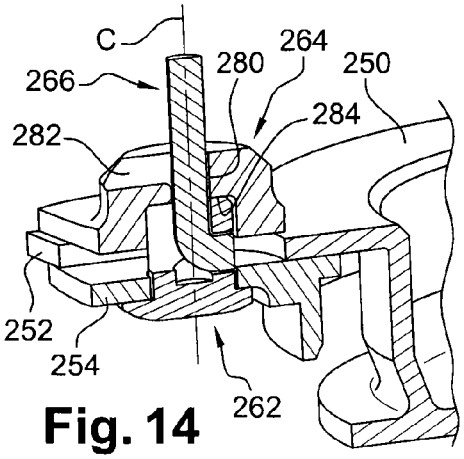
FIGS. 14 and 15 are diagrammatic views in perspective and in axial section of the retaining means of the device of the invention, and they show steps in the mounting of these means.
Figure 15:
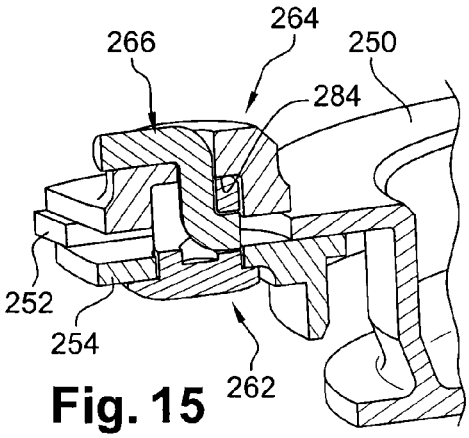

The latch 264 is engaged on the pin 266 and the peg 262, as shown in FIG. 14, by moving in translation along an axis parallel to the axis C of the pin and of the peg. In the mounted position, the plate of the latch 264 bears against the tab 252 of the centering means, the peg 262 is engaged in the larger-diameter bottom portion of the orifice 280 in the latch, and the pin 266 is engaged in the top portion of the orifice. The end portion of the pin 266 that extends outside the latch 264 is for folding down by plastic deformation until it is received in the groove 282 of the latch 264 (FIG. 15). The step of deforming the pin 266 may be performed by means of a suitable tool. This enables the latch to be held stationary on the peg and serves to terminate mounting the retaining means 256. The same operation is repeated for the other retaining means 256 of the device 210.

Figure 16:
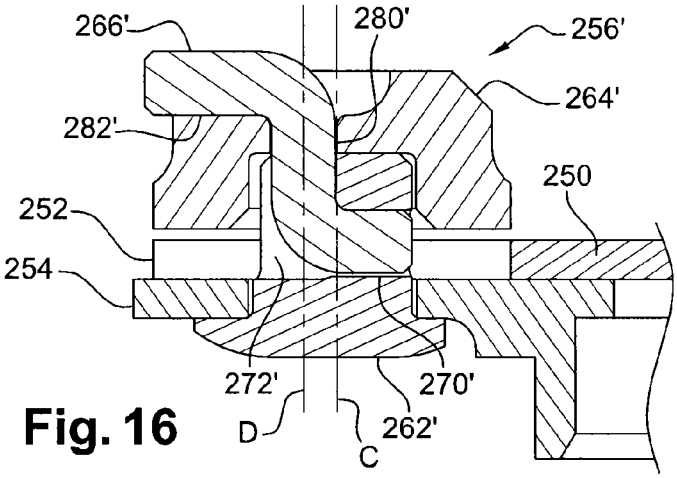
FIG. 16 is a diagrammatic view in axial section of a variant embodiment of the retaining means of the device of the invention.

FIG. 16 shows a variant embodiment of the retaining means 256' of the device of the invention, each retaining means including keying means that prevent the latch being wrongly mounted. It is preferable for the deformed portion of the pin 266' to be folded radially outwards, not radially inwards, relative to the axis of the device. The variant shown in FIG. 16 serves to ensure that mounting is performed in this way because of the fact that the main longitudinal axis D (i.e. the longitudinal axis of the longer portion) of the pin 266' is parallel to and remote from the axis C of the peg 262', when the pin is in the mounted position in the housing in the peg. Since the above-mentioned axis D of the pin is in alignment with the axis of elongation of the slot 272' of the peg, this axis of elongation must be parallel to and spaced apart from the axis C of the peg. Prior to plastic deformation of the pin 266', the free end portion thereof that extends outside the latch is thus not in alignment with the axis C of the peg. The bottom and top portions of the orifice 280' of the latch 264' do not lie on the same axis, as can be seen in FIG. 16. The latch 264' can therefore be mounted on the pin 266' and the peg 262' in only one position in which its groove 282' has its end remote from the orifice 280' opening radially outwards. Once deformed, the pin 266' is generally Z-shaped. The above-mentioned keying means prevent the pin adopting a U-shape on being plastically deformed.

The device 210 of the invention having the retaining means 256 of FIGS. 3 to 15 or having the means 256' of FIG. 16, may be mounted as follows.

The sheath 230 is engaged in an orifice in the chamber end wall 218 and is brazed therein so that its radial tabs 254 are situated on a circumference centered on the axis of the chamber (FIG. 5). A peg 262, 262' (FIG. 6) is engaged in the orifice 258 of each tab 254 of the sheath and is positioned in such a manner that its shoulder 268 comes to bear against the downstream radial face of the tabs 254 (FIGS. 7 to 9). The centering means are engaged in the sheath 230 and its tabs 252 are caused to bear axially against the tabs 254 of the sheath, the pegs 262, 262' carried by the tabs 254 passing through the notches 260 in the tabs 252 of the centering means (FIG. 10). The pegs 262, 262' pass through the notches 260 with radial and circumferential clearance so as to allow the centering means to move relative to the sheath 230 in a plane parallel to the tabs 252, 256. During these movements, the tabs 252 and 254 slide over one another. A pin 266, 266' (FIG. 11) is engaged in the housing in each peg (FIG. 12). A latch 264, 264' (FIG. 13) is engaged on the pin 266, 266', and on the peg 262, 262' carried by each tab 254, until it comes to bear against the corresponding tab 252 (FIG. 14). The free portion of each pin 266, 266' is then folded down in the groove 282, 282' of the corresponding latch in order to be held stationary therein (FIGS. 15, 3, 4).

As described above, the invention may be applied to the technology shown in FIG. 1, in which case the retaining means may be mounted upstream from the swirlers and may co-operate with an annular rim or with radial tabs of a centering ring.

The invention claimed is:

1. A device for injecting a mixture of air and fuel into a turbine engine combustion chamber, the device comprising:

support means;

centering means for centering a fuel injector, said centering means being movable radially in the support means for fastening to a wall of the chamber, the support means carrying retaining means for axially retaining the centering means on a side opposite from the chamber wall, the retaining means are fastened in releasable manner to the support means, wherein the retaining means comprise at least one peg carried by the support means, a latch engaged on the peg and holding the centering means against the support means, and a pin having one end portion engaged and prevented from moving in a housing of the peg and having an opposite end portion bearing against the latch to prevent the pin from moving relative to the peg.

2. A device according to claim 1, wherein the support means comprise at least one radially outer wall or tab for guiding or bearing against the centering means, and wherein the retaining means are releasably fastened to said wall or tab.

3. A device according to claim 2, wherein the support means comprise two diametrically opposite tabs extending radially outwards.

4. A device according to claim 3, wherein the centering means comprise two radially outer tabs that are diametrically opposite and that are held against the tabs of the support means by the retaining means that pass through orifices or notches in the tabs of the centering means with circumferential and radial clearance.

5. A device according to claim 4, wherein the tabs of the centering means are held against the tabs of the support means by two mutually independent retaining means.

6. A device according to claim 5, wherein the latch includes a groove into which the end portion of the pin remote from the peg is folded down by plastic deformation.

7. A device according to claim 6, wherein the housing in the peg is L-shaped and includes a transverse passage receiving one end of the pin and a longitudinal slot connecting the transverse passage to one end of the peg.

8. A device according to claim 7, wherein an axis of elongation (D) of the slot in the peg is in alignment on a longitudinal axis (C) of the peg or is parallel to said axis and spaced apart therefrom.

9. A device according to claim 8, wherein the peg is engaged in an orifice of the support means and includes an annular shoulder bearing axially against the support means, the shoulder including a substantially planar portion configured to engage with a complementary shape of the support means.

* * * * *